US006276324B1

(12) United States Patent
Adams et al.

(10) Patent No.: US 6,276,324 B1
(45) Date of Patent: Aug. 21, 2001

(54) OVERHEAD RING CAM ENGINE WITH ANGLED SPLIT HOUSING

(75) Inventors: Gar M. Adams, Chilton; Thomas A. Immel, Malone, both of WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 09/538,440

(22) Filed: Mar. 29, 2000

Related U.S. Application Data

(60) Provisional application No. 60/128,264, filed on Apr. 8, 1999.

(51) Int. Cl.[7] ..... F01L 1/02

(52) U.S. Cl. ..... 123/90.27; 123/90.39; 123/90.44; 123/90.6

(58) Field of Search ..... 123/90.27, 90.39, 123/90.44, 90.6

(56) References Cited

U.S. PATENT DOCUMENTS

| | | | | |
|---|---|---|---|---|
| 951,965 | | 3/1910 | Potter . | |
| 1,087,803 | | 2/1914 | Melling . | |
| 1,147,313 | | 7/1915 | Desort . | |
| 1,220,274 | * | 3/1917 | Richardson et al. | 123/90.21 |
| 1,239,933 | | 9/1917 | Miller et al. . | |
| 1,428,412 | | 9/1922 | Beauchamp et al. . | |
| 1,542,617 | | 6/1925 | Guy et al. . | |
| 1,816,019 | | 7/1931 | Marxen . | |
| 1,997,842 | * | 4/1935 | Waltz | 123/90.16 |
| 2,218,332 | | 10/1940 | Fowler | 123/195 |
| 2,980,089 | | 4/1961 | Sampoetro | 123/90 |
| 3,045,657 | | 7/1962 | Sampoetro | 123/90 |
| 4,502,427 | | 3/1985 | Brille | 123/90.41 |
| 4,513,702 | | 4/1985 | Koga et al. | 123/193 H |
| 4,697,555 | | 10/1987 | Fujikawa et al. | 123/90.23 |
| 4,711,202 | | 12/1987 | Baker | 123/90.26 |
| 4,722,306 | | 2/1988 | Fujikawa et al. | 123/90.2 |
| 4,736,717 | | 4/1988 | Fujikawa et al. | 123/90.2 |
| 4,930,469 | | 6/1990 | Kamprath et al. | 123/195 |
| 4,977,868 | | 12/1990 | Holschuh | 123/182 |
| 5,007,307 | | 4/1991 | Tamazawa et al. | 74/606 R |
| 5,031,591 | | 7/1991 | Shinoda et al. | 123/196 |
| 5,040,500 | | 8/1991 | Reece | 123/90.27 |
| 5,058,540 | | 10/1991 | Matsumoto | 123/90.17 |
| 5,099,805 | * | 3/1992 | Ingalls | 123/90.15 |
| 5,143,033 | | 9/1992 | Catterson et al. | 123/195 R |
| 5,213,074 | | 5/1993 | Imagawa et al. | 123/196 M |
| 5,267,536 | | 12/1993 | Imagawa et al. | 123/90.23 |
| 5,293,847 | | 3/1994 | Hoffman et al. | 123/90.6 |
| 5,357,917 | | 10/1994 | Everts | 123/90.39 |
| 5,447,127 | | 9/1995 | Luck et al. | 123/90.31 |
| 5,501,186 | | 3/1996 | Hara et al. | 123/90.16 |
| 5,513,606 | | 5/1996 | Shibata | 123/184.34 |
| 5,588,408 | | 12/1996 | Kurihara | 123/196 W |
| 5,606,943 | | 3/1997 | Tamba et al. | 123/90.23 |
| 5,615,586 | | 4/1997 | Phillips et al. | 74/567 |
| 5,706,769 | | 1/1998 | Shimizu | 123/90.23 |

FOREIGN PATENT DOCUMENTS

| | | | |
|---|---|---|---|
| 1 134 553 | | 8/1962 | (DE) . |
| 222238 | | 5/1924 | (GB) . |
| 260506 | | 5/1926 | (GB) . |
| 1604605 | * | 12/1981 | (GB) . |
| 2 184 783 | | 7/1987 | (GB) . |
| 54-27615 | | 3/1979 | (JP) . |
| 58-074855 | | 6/1983 | (JP) . |

* cited by examiner

*Primary Examiner*—Thomas Denion
*Assistant Examiner*—Jaime Corrigan
(74) *Attorney, Agent, or Firm*—Baker & Daniels

(57) ABSTRACT

An overhead cam engine with a drive train including a crankshaft, connecting rod, and piston assembly for reciprocating the piston within the cylinder bore of a cylinder block. A cam ring rotates on the same axis as that along which the piston reciprocates, and has lobes on its upper surface for periodically actuating a pair of rocker arms which open and close intake and exhaust valves located within the cylinder head. The cam ring is driven at half speed by the crankshaft through a gear train arrangement including a timing shaft disposed on an axis parallel to the piston axis with gears at both ends for connecting the crankshaft with the cam ring.

15 Claims, 3 Drawing Sheets

OVERHEAD RING CAM ENGINE WITH ANGLED SPLIT HOUSING

CROSS REFERENCE TO RELATED APPLICATIONS

This application claims the benefit under Title 35, U.S.C. § 119(e) of U.S. Provisional Patent Application Ser. No. 60/128,264, entitled OVERHEAD RING CAM ENGINE WITH ANGLED SPLIT HOUSING, filed on Apr. 8, 1999.

BACKGROUND OF THE INVENTION

1. Field of the Invention

The field of the present invention relates to overhead valve engines, such as overhead cam engines, for use in a variety of applications such as lawnmowers, other lawn and garden implements, or in small utility vehicles such as riding lawnmowers, lawn tractors, and the like. In particular, the invention relates to a drive train for such engines where the intake and exhaust valves are actuated by rocker arms which are rotated by a cam ring, the cam ring driven by a timing shaft with gears at each end to connect the cam ring to the crankshaft.

2. Description of the Related Art

Prior known engines that contain drive trains of an overhead valve design are well known in the art. In one arrangement, the crankshaft supplies rotary mechanical motion to a camshaft by means of a belt, chain, or the like through a pulley or sprocket mounted on the camshaft. The camshaft includes one or more lobes that actuate the intake and exhaust valves in the cylinder head either directly, or indirectly through the use of rocker arms, push rods, or other similar means.

In another arrangement, the crankshaft drives a camshaft located near the crankcase through a gear set. The camshaft includes one or more lobes which actuate a pair of cam followers mounted for rotation on a cam follower shaft. The cam followers in turn reciprocate a pair of push rods extending therefrom to the cylinder head, which in turn rotate a pair of rocker arms mounted in the cylinder head to open and close intake and exhaust valves.

A disadvantage with the first arrangement is that the location of the camshaft in the cylinder head increases the width of the cylinder head due to the lateral space between cam lobes and between a cam lobe and the pulley or sprocket which is driven from the crankshaft. In addition, the location of the camshaft directly above the valves, and the relatively large size of the pulley or sprocket necessary for speed reduction from the crankshaft increase the length of the cylinder head. Further, the belt or chain which drives the camshaft from the crankshaft is prone to wearing or breakage.

A disadvantage with the second arrangement is that the several components of the drive train, including the camshaft, camshaft lobes, cam followers, cam follower shafts, push rods, and rocker arms tend to increase the size, complexity, and cost of the engine, as well as the difficulty of assembly and likelihood of failure of one of the components. The relatively large number of reciprocating parts additionally increases engine noise.

An additional disadvantage of each of the above arrangements is that they permit little variation in the location, size, and arrangement of the components thereof, and therefore restrict design freedom.

What is needed is an engine having a drive train which is compact, to allow a smaller cylinder head, shorter engine length, and an overall reduced engine silhouette.

Another need is for an engine having a drive train including a minimum number of durable components and a minimum number of reciprocating components.

A further need is for an engine in which the location and size of the drive train components may be varied to allow a large degree of design freedom.

SUMMARY OF THE INVENTION

The present invention provides a drive train for an overhead cam engine where the cylinder head valves are actuated by rocker arms having cam follower portions which engage cam lobes on an upper surface of a cam ring which rotates on an axis coincident with the axis on which the piston reciprocates, and is driven by the crankshaft through the drive linkage.

The drive linkage may be a gear train arrangement including a drive gear mounted to the crankshaft which drives a timing shaft having gears at each end thereof, which in turn drives the cam ring. The valve sequence, kinematics and timing are controlled by the lobe placement on the cam ring. In one embodiment, the cam ring includes gear teeth about an outer periphery thereof, which are in engagement with a gear mounted on the timing shaft. In a second embodiment, the cam ring rotates with a gear ring attached to the underside of the cam ring. The cam ring or gear ring may be carried on a plane bearing on a top surface of the cylinder head, such that the cam ring rotates around the valve stems, and valve stems extend through the center of the cam ring.

In one form thereof, an overhead cam engine is provided, including a crankshaft, connecting rod and piston assembly, the piston reciprocating within a cylinder bore in a cylinder block along an axis, the cylinder block connected to a cylinder head; a cam ring supported in the cylinder head above the cylinder bore for rotation about the axis, the cam ring including an upper surface with at least one cam lobe protruding therefrom; drive linkage connected between the crankshaft and the cam ring; and a pair of rocker arms rotatably mounted in the cylinder head, the rocker arms engaging the at least one cam lobe to actuate a pair of valves in the cylinder head.

In another form thereof, the cam ring has gear teeth around an outer periphery thereof, and is supported for rotation on the cylinder head about the piston axis.

In a further form thereof, an overhead cam engine is provided including a crankshaft, connecting rod and piston assembly, the piston reciprocating within a cylinder bore and a cylinder block along an axis, the cylinder block connected to a cylinder head; a gear ring rotatably supported on the cylinder head above the cylinder bore; a cam ring attached to the gear ring and rotatable therewith about an axis parallel to the piston axis, the cam ring including an upper surface and at least one cam lobe protruding from the upper surface; drive linkage connected between the crankshaft and the gear ring; and a pair of rocker arms rotatably mounted in the cylinder head, the rocker arms engaging the at least one cam lobe to actuate a pair of valves in the cylinder head.

An advantage of this arrangement is that the cam ring design permits the valves to be disposed in a plane which may be oriented at an infinite number of rotational angles relative to the crankshaft. Therefore, the intake an exhaust ports, muffler and carburetor may be disposed at a variety of locations on the engine block. Additionally, the valves may be oriented in a plane which allows maximum access to cooling air directed thereto from the flywheel.

An additional advantage is that the cam ring obviates the need for a camshaft, and the location of the cam ring may be shifted either toward or away from the crankshaft along the piston axis, where the length of the timing shaft is easily varied to accommodate various locations of the cam ring. This allows the engine dimension from the crankshaft to the extreme edge of the rocker box cover, and the engine silhouette, to be reduced as compared to a typical overhead camshaft engine.

Additionally, the number and location of the lobes on the cam ring may be varied such that the cam ring may actuate two or four valves. Also, the number of reciprocating components in the drive train is minimized, resulting in quieter operation of the engine.

The timing shaft is located in a timing shaft pocket integral with the cylinder block, and is disposed underneath the cylinder block parallel with the cylinder bore in a vertical crankshaft orientation, or oriented vertically adjacent the cylinder bore in a horizontal crankshaft configuration. In either configuration, the timing shaft pocket provides a passage for returning lubricating oil to the crankcase from the rocker box located above the cylinder head.

In addition, the engine includes a crankcase which is split along a plane disposed at an angle acute to the crankshaft to define a cylinder casing and a mounting flange casing, allowing both of the crankshaft journals to be carried in fill bearings. The cylinder block, cylinder head, and flywheel bearing are integral with the cylinder casing. The main bearing is located within the mounting flange casing. Splitting the cylinder and mounting flange casings in this manner additionally allows for direct access to the internal bore of the cylinder and the valve group during engine assembly.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION

Figure 1:
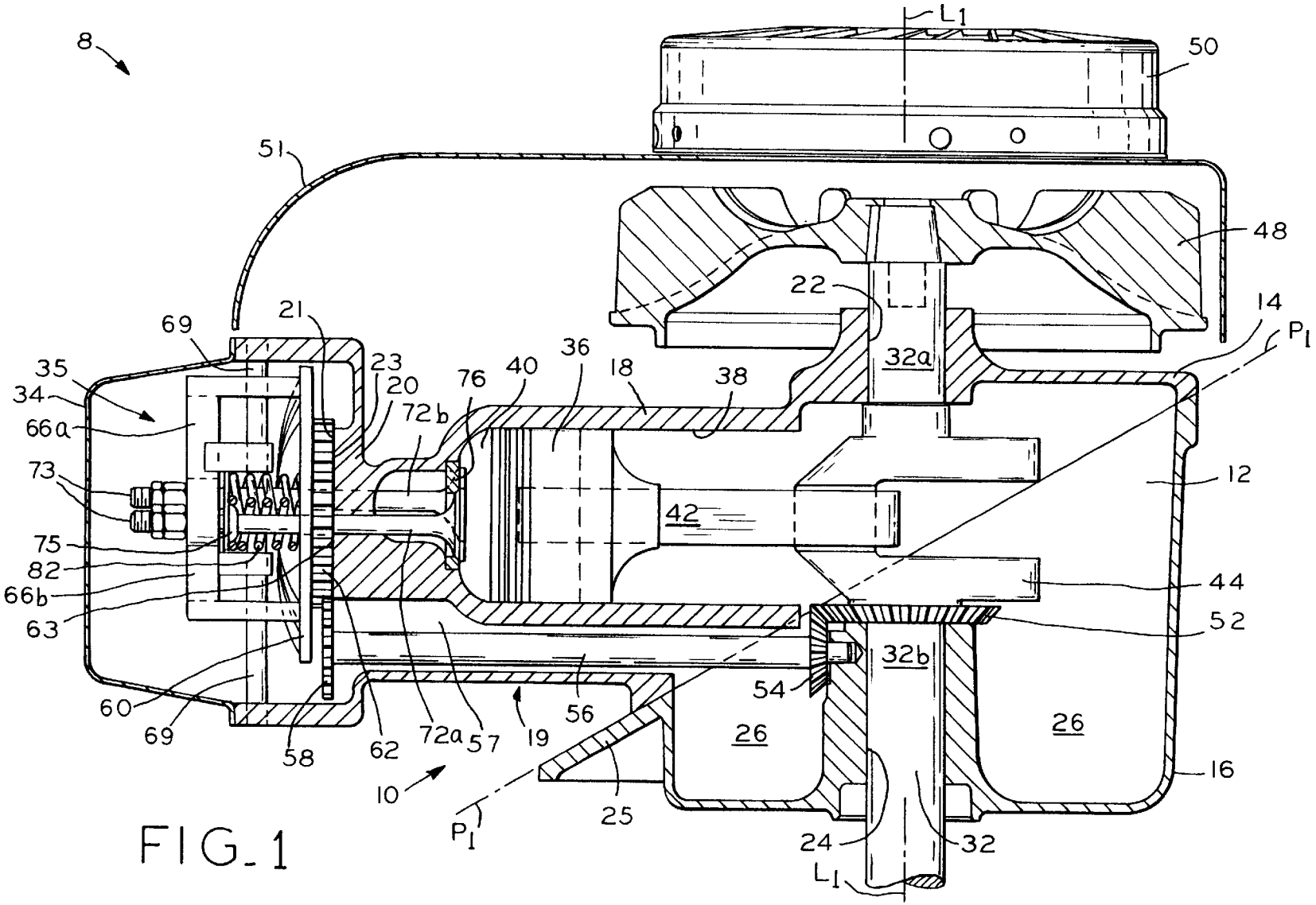
FIG. 1 is a longitudinal sectional view of an overhead cam engine in accordance with the present invention.

Referring to FIG. 1, an overhead cam engine 8 is shown, having drive train 10. As shown in FIG. 1, engine 8 includes crankshaft 32 oriented vertically for a vertical shaft application; however, crankshaft may be oriented horizontally for a horizontal shaft application with certain modifications as is well known in the art. Engine 8 includes crankcase 12, which is split along plane $P_1$—$P_1$ to define cylinder casing 14 and mounting flange casing 16. Cylinder casing 14 includes an integrally cast cylinder block 18, cylinder head 20 and a bore forming upper crankshaft bearing 22. Mounting flange casing 16 includes an integrally cast mounting flange 25 and a bore forming lower crankshaft bearing 24. Mounting flange casing 16 additionally carries oil sump 26 when engine 8 is configured such that crankshaft 32 is oriented vertically. Journals 32*a* and 32*b* of crankshaft 32 are rotatably carried in upper and lower crankshaft bearings 22 and 24, respectively.

Cylinder casing 14 and mounting flange casing 16 are joined in a conventional manner along face or plane $P_1$—$P_1$, which is oriented at an acute angle in relation to crankshaft axis $L_1$—$L_1$ such that journals 32*a* and 32*b* of crankshaft 32 are carried in full upper and lower crankshaft bearings 22, 24. Additionally, splitting cylinder casing 14 and mounting flange easing 16 in this manner allows for direct access to the interior of cylinder bore 38 and the valve group for machining during assembly of engine 8 prior to the attachment of cylinder casing 14 and mounting flange casing 16. Rocker box cover 34 may be affixed to cylinder block 18 in a conventional manner, and together with cylinder head 20, defines rocker box 35.

Piston 36 is slidably received in cylinder bore 38 within cylinder block 18 along an axis $L_2$—$L_2$ (FIGS. 2, 3), perpendicular to crankshaft axis $L_1$—$L_1$. Combustion chamber 40 is defined by the top edge of piston 36 and the walls of cylinder bore 38. Connecting rod 42 is rotatably connected to piston 38 by a wrist pin (not shown), and is also rotatably connected to crankshaft 32 between throws 44 in a conventional manner. Crankshaft is connected to and drives cam ring 60 through drive linkage 19. Flywheel 48 is secured to crankshaft 32 and recoil starter assembly 50 is attached to blower housing 51 and to cylinder block 18 in a conventional manner.

Drive gear 52, shown as a bevel gear, is mounted on crankshaft 32 and drives lower timing shaft gear 54 mounted on timing shaft 56, also shown as a bevel gear. Timing shaft 56 includes upper timing shaft gear 58 mounted thereon. As shown in FIG. 1, drive gear 52 is sized such as to engage lower timing shaft gear 54 and drive timing shaft 56 and upper timing shaft gear 58 at double engine speed. Drive gear 52, upper and lower timing shaft gears 58, 54, and gear ring 62 may be made of powder metal, injection molded plastic, or cast metal, for example.

Timing shaft 56 is disposed in timing shaft pocket 57, which is integral with cylinder block 18 and parallel to axis $L_3$—$L_3$. Timing shaft pocket 57 is disposed beneath cylinder block 18 when crankshaft 32 is oriented vertically, and is disposed vertically adjacent cylinder block 18 when crankshaft 32 is oriented horizontally. In either configuration, oil may be pumped from oil sump 26 through timing shaft pocket 57 by means of a gerotor pump or under pressure generated from the reciprocation of piston 36, for example, to rocker box 35 to lubricate rocker box 35. The oil may then drip back to oil sump 26 through timing shaft pocket 57.

Figure 2:
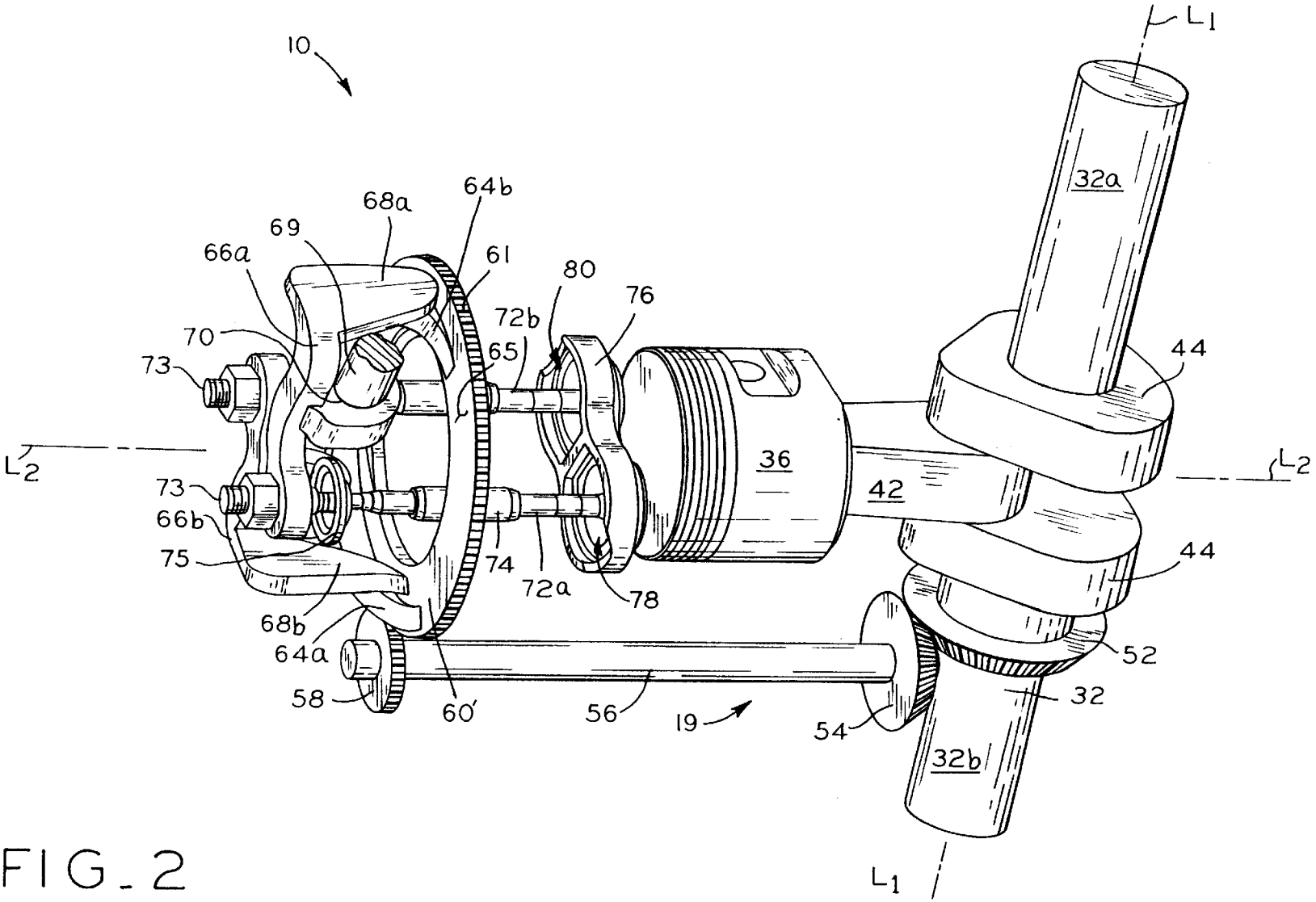
FIG. 2 is a perspective view of the drive train, showing the piston, crankshaft, drive gear, timing shaft with upper and lower timing shaft gears, cam ring, and rocker arms.
Figure 3:
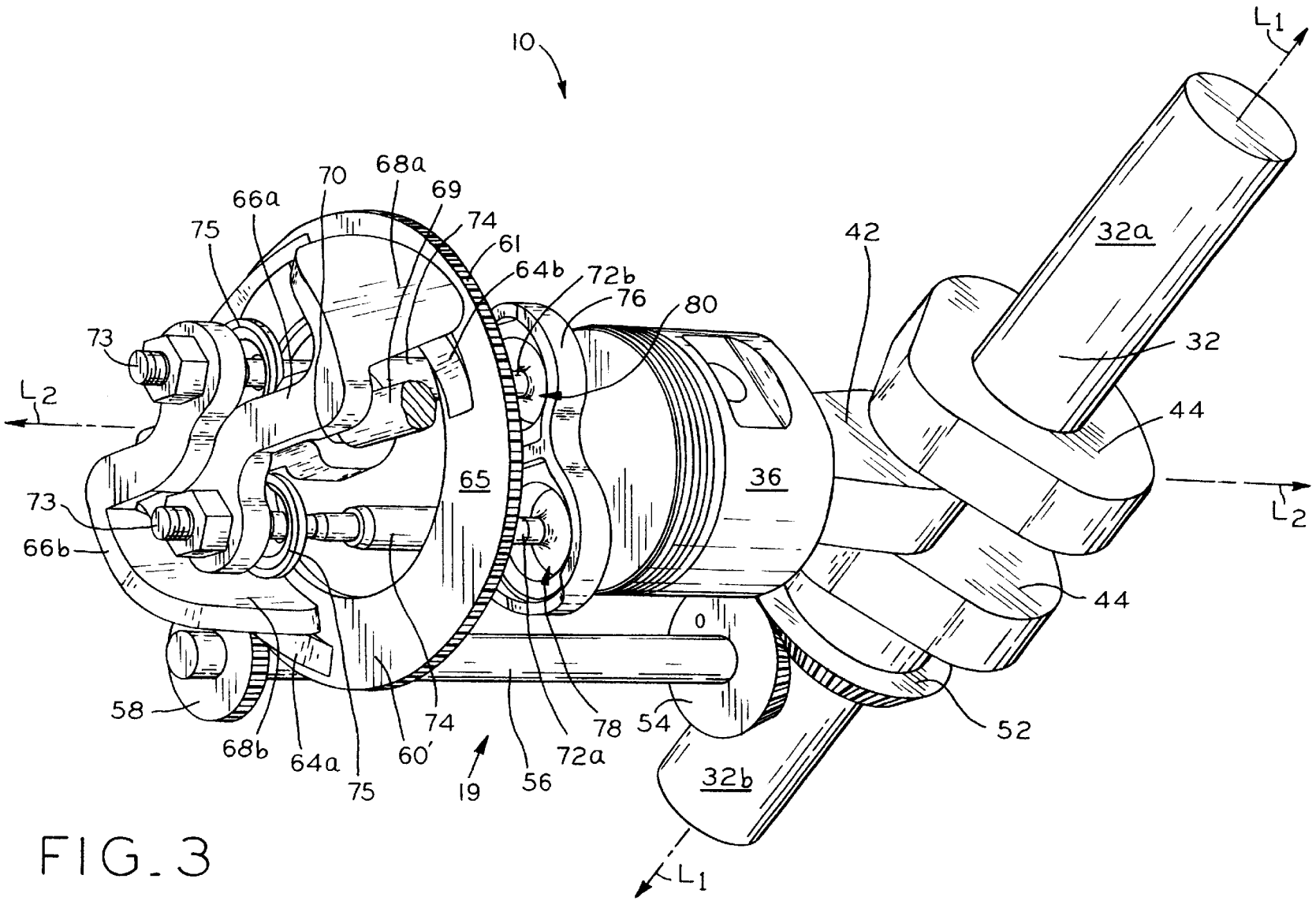
FIG. 3 is a further perspective view of the drive train of FIG. 2.

In FIG. 1, a first embodiment is shown, in which upper timing shaft gear 58 drives cam ring 60 at half crankshaft speed by intermeshing with gear ring 62 disposed beneath and connected to bottom surface 23 of cam ring 60, where gear ring 62 and cam ring 60 rotate together. In FIGS. 2 and 3, a second embodiment is shown, wherein upper timing shaft gear 58 drives cam ring 60' by intermeshing with teeth 61 disposed around an outer periphery of cam ring 60'. Cam ring 60 and gear ring 62, which can be integral, may be supported for rotation on a top surface 21 cylinder head 20 by plane bearing 63 as shown in FIG. 1, or may also be supported by a frictionless bearing.

In each of the two embodiments shown in FIGS. 1–3, the net speed reduction from crankshaft 32 to cam rings 60, 60' is 2:1, enabling drive train 10 to operate in a conventional four stroke cycle.

Referring to FIG. 2, cam ring 60' includes integrally formed lobes 64*a* and 64*b*, which protrude from top surface 65 of cam ring 60. Each lobe 64*a* and 64*b* has an inclined or sloped surface tapering at each end thereof to define a cam profile. Rocker arms 66*a* and 66*b* include rounded cam follower portions 68*a* and 68*b* in engagement with cam ring 60', which engage lobes 64*a* and 64*b* of cam ring 60 as cam ring 60' rotates, causing rocker arms 66*a* and 66*b* to pivot around stationary mounting shafts or bosses 69, which may be integral with cylinder head 20 and formed as stub shafts. Mounting shafts 69 extend through apertures 70 upon which rocker arms 66*a* and 66*b* are mounted. Rocker arms 66*a* and 66*b* engage and actuate valves 72*a*, 72*b* in a conventional manner.

Referring to FIG. 1, valves 72*a* and 72*b* are supported within valve guides 74 (FIGS. 2–3) disposed within cylinder head 20 substantially parallel to axis $L_2$—$L_2$. Valves 72*a* and 72*b* seat against valve seats 76 which are either integrally cast or press-fitted into the open ends of the intake and exhaust ports 78, 80 (FIGS. 2—3), which may extend inwardly from opposite sides of cylinder head 20 in a cross-flow orientation. Lash adjusting screws 73 are secured to rocker arms 66*a*, 66*b*, and abut valves 72*a*, 72*b*. Valve springs 82 (FIG. 1), comprising coil springs, are mounted under compression around valves 72*a*, 72*b* between valve keepers 75 and top surface 21 of cylinder head 20 to thereby bias valves 72*a*, 72*b* against valve seats 76 to the closed position. By appropriately modifying cam ring 60 by adding additional lobes, four or more valves could be actuated.

Referring to the embodiment of FIGS. 2 and 3, the same reference numerals have been used for corresponding elements. In this embodiment, as well as in the embodiment of FIG. 1, the drive train operates as follows. On the intake stroke, lobe 64*a* on cam ring 60' contacts rounded cam follower portion 68*a*, causing rocker arm 66*a* to rotate and open valve 72*a*, allowing a fuel/air mixture from the carburetor (not shown) into combustion chamber 40 through intake port 78. On the compression and power strokes, rounded cam follower portions 68*a*, 68*b* of rocker arms 66*a*, 66*b* are not in contact with lobes 64*a*, 64*b* on cam ring 60', and valve springs 82 bias valves 72*a*, 72*b* closed.

On the exhaust stroke, lobe 64*b* on cam ring 60 contacts rounded cam follower portion 68*b*, causing rocker arm 66*b* to rotate around its stationary mounting shaft thereby opening valve 72*b*, allowing exhaust gas to vent through exhaust port 80. The sequence and timing of the actuation of the intake and exhaust valves are determined by the placement and shape of lobes 64*a*, 64*b* on cam rings 60, 60'. As shown in FIGS. 1–3, cam rings 60, 60' each includes two lobes 64*a*, 64*b* for actuating two rocker arms 66*a*, 66*b* and two valves 72*a*, 72*b*. However, additional lobes on cam rings 60, 60' as well as additional rocker arms may be added to enable cam rings 60, 60' to actuate additional valves in single and multi-cylinder configurations.

In the embodiment shown in FIG. 1, it may be seen that valves 72*a*, 72*b* are disposed in a plane which is oriented substantially perpendicular to crankshaft axis $L_1$—$L_1$, allowing cooling air from flywheel 48 to be directed by blower housing 51 into contact with cylinder head 20 equally around valves 72*a*, 72*b*. In the embodiment shown in FIGS. 2 and 3, it may be seen that intake and exhaust valves 72*a*, 72*b* are disposed in a plane which is oriented at a skew angle relative to each of crankshaft axis $L_1$—$L_1$ and piston axis $L_2$—$L_2$. It should be understood from FIGS. 1–3 and from the above description that the unique construction of cam ring 60 and rocker arms 66*a*, 66*b* disclosed herein allows valves 72*a*, 72*b* to be oriented in a plane which may be disposed perpendicular to crankshaft 32, parallel to crankshaft 32, or at any one of an infinite number of rotational skew angles relative to crankshaft 32.

Additionally, it may be seen from FIGS. 1–3 that valves 72*a*, 72*b* extend through a center portion of cam rings 60, 60'. This construction allows the location of cam rings 60, 60' to be shifted either toward or away from crankshaft 32 as necessary, to accommodate various designs for drive train 10, and the length of timing shaft 56 and cylinder head 20 may vary accordingly therewith.

While the present invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An overhead cam engine comprising:

a crankshaft, connecting rod and piston assembly, said piston reciprocating within a cylinder bore in a cylinder block along an axis, said cylinder block connected to a cylinder head;

a cam ring supported in said cylinder head above said cylinder bore for rotation about said axis, said cam ring including an upper surface, with at least one cam lobe protruding therefrom;

drive linkage connected between said crankshaft and said cam ring; and a pair of rocker arms rotatably mounted in said cylinder head, said rocker arms engaging said at least one cam lobe to actuate a pair of valves in said cylinder head.

2. The engine of claim 1, wherein said valves are oriented in a plane substantially perpendicular to said crankshaft.

3. The engine of claim 1, wherein said valves are disposed in a plane oriented at a skew angle relative to said crankshaft.

4. The engine of claim 1, wherein said cam ring has gear teeth around an outer periphery thereof.

5. The engine of claim 4, wherein said drive linkage comprises:

a drive gear mounted on said crankshaft;

a timing shaft having first and second gears mounted on opposite ends thereof, said first gear engaging said drive gear and said second gear engaging said cam ring.

6. The engine of claim 4, wherein said cam ring is supported on a plane bearing on a top surface of said cylinder head.

7. The engine of claim 1, wherein said cam ring rotates with a gear ring disposed beneath said cam ring.

8. The engine of claim 7, wherein said drive linkage comprises:

a drive gear mounted on said crankshaft;

a timing shaft having first and second gears mounted on opposite ends thereof, said first gear engaging said drive gear and said second gear engaging said gear ring.

9. The engine of claim 7, wherein said gear ring is carried in a plane bearing on a top surface of said cylinder head.

10. The engine of claim 1, wherein said engine is disposed within first and second casings split for attachment to one another along a plane disposed at an angle relative to said crankshaft.

11. An overhead cam engine, comprising:

a crankshaft, connecting rod and piston assembly, said piston reciprocating within a cylinder bore in a cylinder block along an axis, said cylinder block connected to a cylinder head;

a gear ring rotatably supported on said cylinder bead above said cylinder bore;

a cam ring attached to said gear ring and rotatable therewith about an axis parallel to said piston axis, said cam ring including an upper surface and at least one cam lobe protruding from said upper surface;

drive linkage connected between said crankshaft and said gear ring; and a pair of rocker arms rotatably mounted in said cylinder head, said rocker arms engaging said at least one cam lobe to actuate a pair of valves in said cylinder head.

12. The engine of claim 11, wherein said valves are oriented in a plane substantially perpendicular to said crankshaft.

13. The engine of claim 1, wherein said drive linkage comprises:

a drive gear mounted on said crankshaft;

a timing shaft having first and second gears mounted on opposite ends thereof, said first gear engaging said drive gear, and said second gear engaging said gear ring.

14. The engine of claim 11, wherein said gear ring is supported on a plane bearing on a top surface of said cylinder head.

15. The engine of claim 1, wherein said engine is disposed within first and second casings split for attachment to one another an angle relative to said crankshaft.

* * * * *

UNITED STATES PATENT AND TRADEMARK OFFICE

CERTIFICATE OF CORRECTION

PATENT NO. : 6,276,324 B1
APPLICATION NO. : 09/538440
DATED : August 21, 2001
INVENTOR(S) : Gar M. Adams et al.

It is certified that error appears in the above-identified patent and that said Letters Patent is hereby corrected as shown below:

Claim 11, column 7, line 7, delete “bead” and substitute therefor -- head --

Claim 13, column 8, line 4, delete “1” and substitute therefor -- 11 --

Claim 15, column 8, line 13, delete “1” and substitute therefor -- 11 --

Signed and Sealed this

Nineteenth Day of February, 2008

JON W. DUDAS
*Director of the United States Patent and Trademark Office*